United States Patent [19]

Patterson

[11] 4,085,936

[45] Apr. 25, 1978

[54] PRACTICE GOLF CLUB WITH MEANS FOR HOLDING AND RELEASING BALL

[76] Inventor: Roy M. Patterson, 1547 W. Beryl Ave., Phoenix, Ariz. 85021

[21] Appl. No.: 788,518

[22] Filed: Apr. 18, 1977

[51] Int. Cl.[2] ..... A63B 69/36; F41B 3/04

[52] U.S. Cl. ..... 273/186 A; 124/5; 273/186 E; 273/194 R

[58] Field of Search ..... 273/193 R, 193 A, 193 B, 273/194 R, 194 A, 194 B, 162 E, 183 D, 186 A, 186 E, 77 R, 186 R; 124/79, 5

[56] References Cited

U.S. PATENT DOCUMENTS

| | | | |
|---|---|---|---|
| 1,319,310 | 10/1919 | Sokol | 124/5 |
| 1,994,207 | 3/1935 | Ahles | 273/162 E X |
| 2,465,124 | 3/1949 | Quattrin | 273/162 E X |
| 2,856,190 | 10/1958 | Quattrin | 273/193 R |
| 3,300,241 | 1/1967 | Eberwein et al. | 273/162 E X |
| 3,434,722 | 3/1969 | Esposito | 273/186 A |
| 3,466,049 | 9/1969 | Fox et al. | 273/186 A |

*Primary Examiner*—George J. Marlo
*Attorney, Agent, or Firm*—Warren F. B. Lindsley

[57] ABSTRACT

A gold club designed for use in practicing the execution of a proper swing, the club being adapted to hold a golf ball until it is released at the bottom of the swing. The gripping elements are designed to hold the golf ball against the striking face of the club and avoid interference with the natural trajectory of the ball. The ball is released when the golfer pulls on a spring-biased cable extending from a first position located adjacent the golf club grip to a second position, where the cable coacts with the golf ball gripping elements.

9 Claims, 5 Drawing Figures

PRACTICE GOLF CLUB WITH MEANS FOR HOLDING AND RELEASING BALL

BACKGROUND OF THE INVENTION

The proper technique for driving a golf ball with a club involves a throwing action wherein the ball is picked up by the face of the club and is then thrown or slung into the desired trajectory. The perfection of the technique for driving a golf ball thus requires that much attention be given to the follow-through portion of the swing subsequent to the instant of contact with the ball.

The novice or unpracticed golfer has difficulty in recognizing or appreciating this aspect of the sport and tends to apply a striking or hitting action rather than correctly executing the desired throwing technique. Furthermore, the initial difficulty in making a proper connection with the ball severely limits the ability of the practicing golfer to concentrate on the form of the swing and in particular on the follow-through action.

For a more rapid development of a proper golf swing, special learning routines and equipment are thus highly desirable.

SUMMARY OF THE INVENTION

In accordance with the invention claimed, an improved practice golf club is provided for use in developing follow-through wherein the ball is properly positioned and held on the face of the club and is freed from interference by the holding means following its release. The ball is held against one or more pins by a spring-loaded lever and is released by means of a cable extending to a point near the hand-grip.

It is, therefore, one object of this invention to provide an improved practice club for the development of a proper stroke.

Another object of this invention is to provide such a practice club in a form which properly simulates the natural physical relationship between the ball and the face of the club during the follow-through portion of the stroke.

A further object of this invention is to provide such a club in a form which frees the practicing golfer from excessive concern with the initial portion of the stroke involving the location of the ball and its point of contact with the face of the club.

A further object of this invention is to provide such a club in a form incorporating a holding means and a release mechanism whereby the ball is held in position by the holding means during the first portion of the stroke and is released at the bottom of the stroke so that control of the ball is relinquished entirely to the club and the contacting surface of its face during the follow-through swing.

A further object of this invention is to provide such a practice club in a form which adheres as closely as possible to the form of an ordinary golf club so that a natural and easy transition may be made from the practice club to a playing club.

A still further object of this invention is to provide such a practice club in a simple and inexpensive construction.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
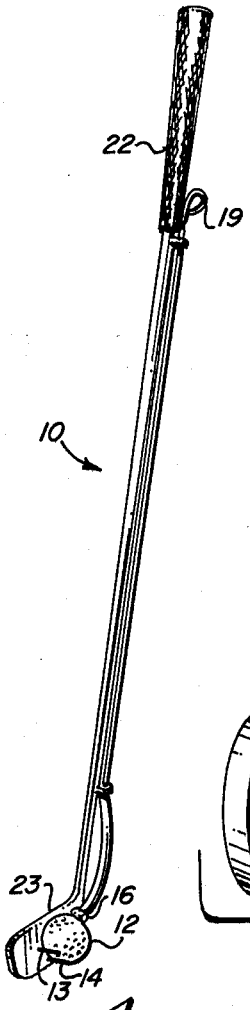
FIG. 1 is a perspective view of a first embodiment of the practice club of the invention as applied to a driving iron.
Figure 2:
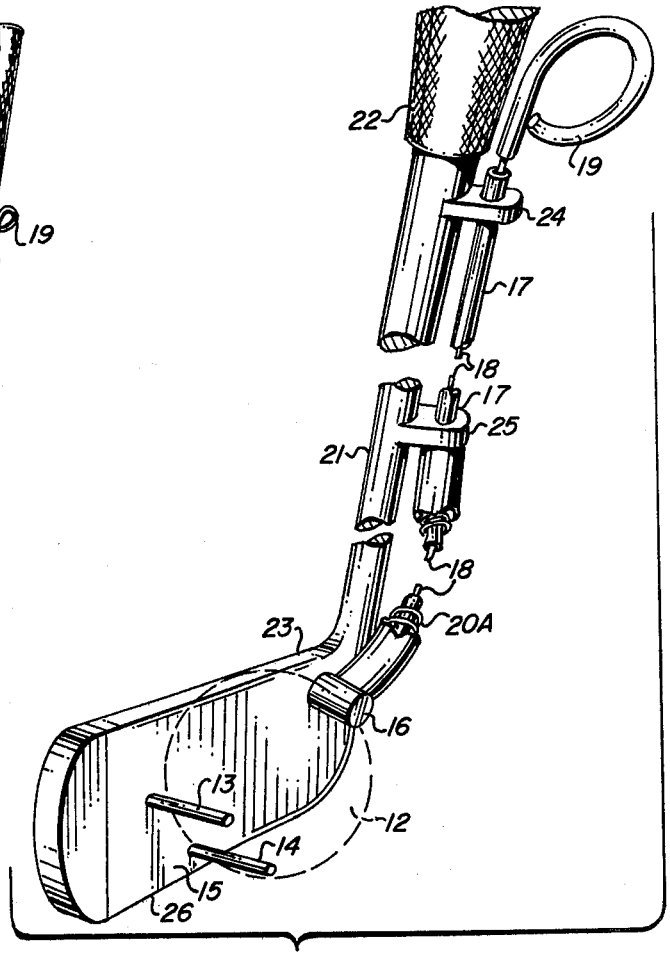
FIG. 2 is an enlarged view of a portion of the practice club of FIG. 1 showing in greater detail the construction of the holding and release mechanisms.
Figure 3:
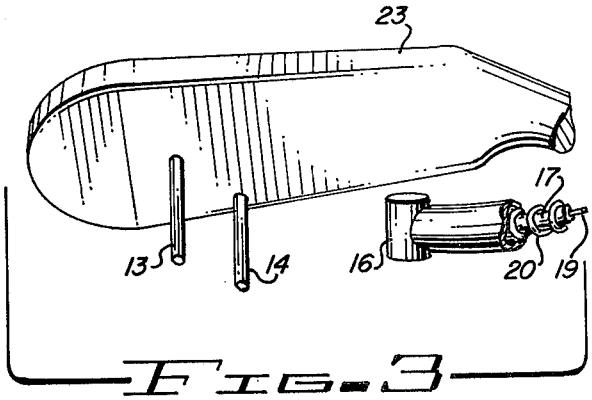
FIG. 3 is an enlarged view of the head of the club of FIG. 1 showing from another angle the configuration of the holding means.

Referring more particularly to the drawing by characters of reference, FIGS. 1–3 disclose a practice golf club 10 coman ordinary driving iron, for purposes of illustration only, which is fitted with means for holding and releasing a golf ball 12.

The holding and releasing means may comprise two pins 13 and 14 which project laterally from a face 15 of the club, a holding finger 16, a tubular guide 17 surrounding a flexible cable 18, a release loop 19 and a compression spring 20 mounted within a tubular housing 20A.

Guide 17 shown surrounding cable 18 is arranged along the side of shank 21 of club 10, extending from a point just below a hand grip 22 on the shank 21 of the club to a point just above the head 23. Attachment means 24 and 25 are provided at two or more points along the length of shank 21 for securing guide 17 to shank 21, means 24 being positioned just below grip 22 and means 25 being positioned just above the club head 23. Guide 17 runs parallel with shank 21 from its upper end to a lower attachment point and then tubular housing 20A attached thereto curves in the direction of pins 13 and 14.

Cable 18 passes through the hollow interior of guide 17, terminating in loop 19 as it emerges from the upper end thereof and attaches to finger 16 as its emergence from the lower end of tubular housing 20A.

Spring 20 is coiled in a cylindrical form and may have an inside diameter somewhat larger than the outer diameter of guide 17 and somewhat smaller than the inside diameter of tubular housing 20A. It is positioned between the lower attachment means 25 and holding finger 16 within tubular housing 20A extending downwardly beyond the lower attachment means 25.

Finger 16, in the first implementation of club 10 as shown in FIGS. 1–3, is in the form of a cylindrical metal stub about ½ inch in length and ¼ inch in diameter. The lower end of cable 18 and spring 20 are attached to the side of finger 16 at approximately its longitudinal center so that the cylindrical axis of finger 16 is arranged perpendicularly to the lower end of cable 18.

Pins 13 and 14 are positioned just outboard of the normal striking position of ball 12 on face 15 of club head 23. They are located about ½ inch apart along a line running diagonally upwardly and outwardly from base 26 of head 23, the line being also approximately perpendicular to the lower extremity of tubular housing 20A.

It will be appreciated that in the arrangement of the structure identified by reference characters 16–20 attached to shank 21 by means 24 and 25, spring 20 urges finger 16 downward toward the position of ball 12, and loop 19 may be utilized to withdraw cable 18 and the attached finger 16 upwardly and away from the position of ball 12. The extended length of tubular housing 20A below member 25 and its positioning and orientation relative to pins 13 and 14 are such that ball 12 is captured between pins 13 and 14 at its one side and finger 16 at its opposite side. The force of spring 20 holds ball 12 securely in this position until cable 18 is withdrawn by means of loop 19, loop 19 being appropriately positioned at the lower end of grip 22 on shank 21 where it may be readily engaged by the index finger of the practicing golfer.

In the utilization of club 10, the golfer places ball 12 in position between pins 13 and 14 and finger 16 and passes his right index finger through the release loop 19 as he grips club 10 in the normal manner. He then swings club 10 in the desired manner toward a point on the ground representing the position where ball 12 would normally exist. If desired, the point may be marked with a tee if a driver head is used and equipped with the disclosed ball-gripping means. As the head of the club passes over the identified point on the ground, the golfer pulls loop 19 to release ball 12. For the remainder of the swing ball 12 and its subsequent trajectory are controlled exclusively by the direction of the swing and by the face of the club bearing directly against the surface of the ball. Because ball 12 is thus ideally positioned at the center of the face of the club independent of the judgment and skill of the golfer, the full concentration of the golfer may be given to the proper execution of the swing relative to the desired hitting or throwing action involved in the follow-through motion.

Figure 4:
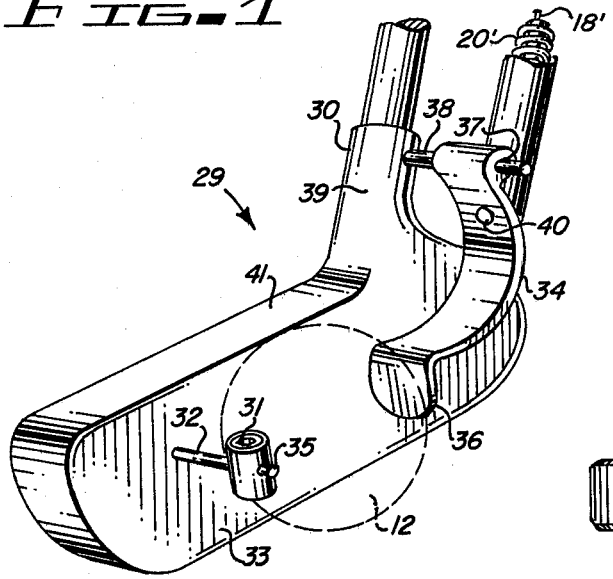
FIG. 4 is a perspective view of a second embodiment of the invention as applied to a putter and incorporating a variation of the holding and release mechanism.
Figure 5:
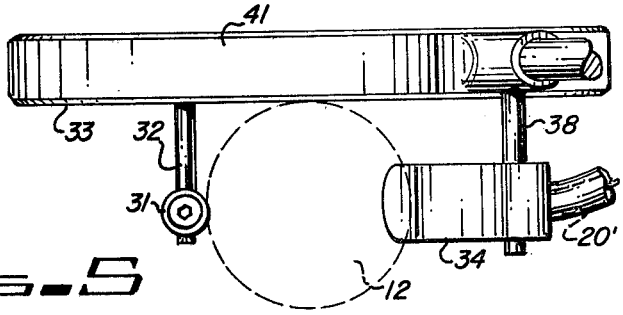
FIG. 5 is an edge view of the putter of FIG. 4 in further clarification of the configuration of the holding and release mechanism.

A second embodiment of the invention is shown in FIGS. 4 and 5 wherein a practice putter 29 is disclosed comprising an ordinary putting head 30 fitted with a holding and releasing mechanism similar to that shown in FIGS. 1–3. Because a more gentle holding action is sufficient in the case of the putter a modified holding and releasing mechanism may be employed.

The holding and releasing mechanism of FIGS. 4 and 5 comprises a bumper bar 31 held by a pin 32 on face 33 of putter 29 just outboard of the position of ball 12. A pivoting lever 34 is provided with its lower end bearing against the opposite inboard surface of ball 12. Lever 34 is urged against the surface of ball 12 by means of a spring, guide, and cable assembly identical to that shown in FIGS. 1–3 and provided with the prime of similar reference characters.

Bumper 31 is a cylindrical metal stub approximately ¼ of an inch in diameter and ½ of an inch in length pierced by a transverse hole 35 which perpendicularly bisects its cylindrical axis. Pin 32 projects perpendicularly from face 33 of head 30 and passes through hole 35 of bumper 31 to support bumper 31 at a location displaced approximately one radius of ball 12 from the surface of face 33. The snug fit of pin 32 in hole 35 holds bumper 31 firmly positioned with the cylindrical surface of bumper 31 tangent to the surface of ball 12.

Lever 34 is formed from a flat strip into an arcuate shape with an outwardly projecting tab 36 at its lower end and a transverse pivot hole 37 at its upper end. A pivot pin 38 extending perpendicularly from the side of neck 39 of putting head 30 passes through hole 37 to pivotally support lever 34, pin 38 being aligned in parallel relationship with pin 32 so that the pivoting motion of lever 34 about pin 38 involves the motion of tab 36 along an arc directed toward bumper 31.

When ball 12 is positioned against the rearward surface of bumper 31 in its normal position on face 33, as shown in FIG. 4, and lever 34 is pivoted forward toward ball 12, tab 36 strikes the surface of ball 12 at a point approximately diametrically opposite the point of tangency of ball 12 with bumper 31.

Cable 18′ is attached to a point 40 located just below the pivotal attachment of lever 34 to pin 38 so that the compression reaction of spring 20′ urges tab 36 against the surface of ball 12 and thereby causes ball 12 to be held in position between tab 36 and bumper 31.

The utilization of practice putter 29 in the perfection of the putting stroke is similar to the utilization of club 10. Ball 12 is first secured in position between bumper 31 and tab 36. As head 41 of the putter and the captured ball pass over the assumed "lie" or starting position of the ball, the releasing loop 19′ is operated to release the ball, and a follow-through action is executed by the practicing golfer to produce the desired trajectory of the ball across the surface of the putting green. The use of the practice putter in this manner very effectively makes the golfer aware of the importance of the follow-through stroke, there being no impact forces involved to interfere with the more desirable throwing or pushing action of the follow-through motion.

An improved practice golf club is thus provided in full accordance with the stated objects of the invention, and although but two embodiments of the invention have been illustrated and described, it will be apparent to those skilled in the art that various changes and modifications may be made therein without departing from the spirit of the invention or from the scope of the appended claims.

What is claimed is:

1. A practice golf club comprising:

a shank portion having a hand gripping area at one end, a head portion having a ball striking surface mounted at the other end of said shank portion, at least one projecting member extending outwardly from said striking surface a distance less than the diameter of a golf ball, means for detachably positioning and holding a golf ball against said member, said means comprising an elongated member mounted on and arranged to extend juxtapositioned to said shank from a point adjacent said gripping area to a point adjacent said striking surface, a finger grip formed on one end of said elongated member adjacent said gripping area for grasping by a finger of the hand of the user engaging the gripping area, a holding finger means mounted on the other end of said elongated member adjacent said striking surface and biased for holding a golf ball against said projecting member and biasing said elongated member toward said projecting member, whereby when said elongated member is pulled toward said gripping area by a finger of a user against the biasing action of said holding finger means a golf ball held between said holding finger means and said projecting member will be released.

2. The practice golf club set forth in claim 1 wherein: said elongated member comprises a flexible cable.

3. The practice golf club set forth in claim 2 wherein: said holding finger means positions and holds a golf ball against said member and the striking surface of said head portion of said golf club.

4. The practice golf club set forth in claim 2 wherein: said projecting member comprises a pair of spaced members each extending laterally of said striking face in the same direction.

5. The practice golf club set forth in claim 4 wherein: said pair of spaced members extending substantially perpendicularly from said striking surface.

6. The practice golf club set forth in claim 1 wherein: said holding finger means is arranged for positioning and holding a golf ball against said member, and spring means positioned between said holding finger means and a point along said elongated member for biasing said holding finger means and said elongated member toward said member.

7. The practice golf club set forth in claim 6 wherein: said spring means comprises a coil spring mounted around a part of said elongated member adjacent said holding finger.

8. The practice golf club set forth in claim 7 in further combination with:

a hollow cylinder surrounding said spring means for predetermining its path of movement.

9. The practice golf club set forth in claim 6 wherein: said holding finger means is pivotally mounted to said striking surface, and said elongated member and said spring means are attached thereto at a point of pivotal movement of said holding finger relative to said striking face.

* * * * *